US005266055A

United States Patent [19]

Naito et al.

[11] Patent Number: 5,266,055

[45] Date of Patent: Nov. 30, 1993

[54] CONNECTOR

[75] Inventors: Akira Naito; Hikohiro Togane, both of Sagamihara, Japan

[73] Assignee: Mitsubishi Denki Kabushiki Kaisha, Tokyo, Japan

[21] Appl. No.: 7,009

[22] Filed: Jan. 21, 1993

Related U.S. Application Data

[63] Continuation of Ser. No. 691,444, Apr. 25, 1991, abandoned, which is a continuation-in-part of Ser. No. 572,359, Aug. 27, 1990, abandoned, which is a continuation of Ser. No. 409,779, Sep. 20, 1989, abandoned.

[30] Foreign Application Priority Data

Oct. 11, 1988 [JP] Japan ..... 63-255097

[51] Int. Cl.[5] ..... H01R 13/66

[52] U.S. Cl. ..... 439/620; 333/181

[58] Field of Search ..... 439/620; 333/181

[56] References Cited

U.S. PATENT DOCUMENTS 3,140,342 7/1964 Ehrreich .
3,456,215 7/1969 Denes .
4,761,147 8/1988 Gauthier ..... 439/620 X

FOREIGN PATENT DOCUMENTS 3148351 7/1982 Fed. Rep. of Germany .
0085616 5/1985 Japan ..... 333/181
237526 4/1945 Switzerland .
1464511 2/1977 United Kingdom .

OTHER PUBLICATIONS

Snyder et al, "Magnetic Ferrites", Electrical Manufacturing, Dec. 1949, pp. 86-91.

*Primary Examiner*—Eugene F. Desmond
*Attorney, Agent, or Firm*—Oblon, Spivak, McClelland, Maier & Neustadt

[57] ABSTRACT

In a connector for connecting an electrical circuit, one or more conductors are embedded in a magnetic body so as to function as inductance. The conductors may have an end portion provided with a capacitor. A main body portion of the connector may include a magnetic compound so as to function as an AC plug.

9 Claims, 6 Drawing Sheets

CONNECTOR

This application is a continuation of application Ser. No. 07/691,444, filed on Apr. 25, 1991, now abandoned, which is a continuation-in-part of 07/572,359, filed Aug. 27, 1990, now abandoned, which is a continuation of 07/409,779, filed Sep. 20, 1989, abandoned.

BACKGROUND OF THE INVENTION

1. Field of the Invention

The present invention is related to a connector (an electrical circuit connecting element), and, in particular, a connector with an electromagnetic interference (hereinbelow, referred to as noise) absorbing means incorporated therein.

2. Discussion of the Background

FIG. 12 is a perspective view showing an example of a conventional connector. FIG. 13 is a perspective view showing the essential portion wherein the conventional connector is mounted on a printed circuit board 42.

In FIG. 12, reference numeral 20 designates a conductor for connection. Reference numeral 21 designates an insulating covering (i.e., a sleeve) which is used when two electrical circuits are connected as shown in FIG. 13.

With a desire of obtaining a noise eliminating effect when the circuit connection between terminals 30*a* and 30*b* of a circuit pattern is made on a printed circuit board 42 and the like as shown in FIG. 13, the following structures have been utilized;

One conventional structure incorporates a noise filter element in a terminal connecting pin 24 to a position adjacent its leading end, the noise filter element comprising ferrite beads 23 embedded in an insulating member 26 as shown in Figure 14 (a first example). Another structure incorporates a noise filter instead of the ferrite beads 23, the noise filter comprising a lead-through capacitor 22 and an earthed lead 25 as shown in FIG. 15 (a second example).

Now, the function/operation of such noise filters will be explained. Signals are sent or received between circuits of a device through the connecting pin 24. Since a noise component included in the signals is absorbed by the ferrite beads 24 or the lead-through capacitor 22, the connecting pin can eventually function as a noise filter.

FIG. 16 is a perspective view of a third example of the noise filter element wherein the first and the second example are combined to have the capacitor 22 and ferrite beads 23. As shown in FIG. 17, the filter noise element of FIG. 16 can be connected to the conventional ordinary type of connector of FIG. 12 to eliminate conduction noise. In FIGS. 16 and 17, reference numerals 24, 24*a*, 24*b* and 25 indicate terminals.

FIG. 18 shows an equivalent circuit of the circuit shown in FIG. 17. Specifically, a signal which has been transmitted from the terminal 30 is transmitted to the terminal 24*a* through the connector 20, and a noise component included in the signal can be eliminated by the capacitor 22 and the equivalent inductance 23*a* given by the ferrite beads 23. Then, the signal is output from the terminal 30*b*.

In addition, FIG. 19 is a connection diagram showing an example of an AC plug with a noise filter as an application example of this type of connector.

In FIG. 19, reference numeral 40 designates an AC cable. Reference numerals 41*a*, 41*b* and 42 designate a pair of AC plug pins and a connecting terminal pin, respectively. Reference numeral 43 designates a pair of capacitors. Reference numeral 44 designates a choke coil. The AC plug has such structure that the members 40–44 are molded in an insulating plug body 45 as a connector main body.

Noise which has come from the AC plug pins 41*a* or 41*b* is absorbed by an LC filter which is constituted by the choke coil 44 and the capacitors 43, and then is transmitted to the side of the AC cable 40.

Since the conventional methods for eliminating conduction noise requires the structure as mentioned above, a number of different kinds of electrical parts must be utilized in the conventional noise eliminating structures in order to realize both electrical connection and noise elimination. In particular, the third conventional example (FIGS. 16 and 17) has a disadvantage in terms of mounting space and economy. The conventional fourth example (FIG. 9) in the form of an AC plug has disadvantages in that it is bulky and heavier, and it is not suitable for mass production. In addition, these conventional devices have a disadvantage in that they are of little effect with respect to radiation noise.

SUMMARY OF THE INVENTION

It is an object of the present invention to eliminate the disadvantages of the conventional devices, and to provide a connector which is capable of making an electrical connection between electrical circuits, and of eliminating conduction noise and radiation noise, and which is compact and suitable for mass production.

The foregoing and other objects of the present invention have been attained by providing a connector for connecting electric circuits, wherein one or more conductors are embedded in a magnetic body so as to function as inductance, independently of a capacitor or together with a capacitor.

Since the present invention has this structure, the present invention can provide a small sized and highly efficient connector with a filter circuit element which can absorb various kinds of noise by equivalent inductance and comprises the conductor or the conductors embedded in the magnetic body, or an LC circuit comprising the combination of the equivalent inductance and the equivalent capacitance comprising a chip capacitor.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Now, the present invention will be described in detail with reference to preferred embodiments illustrated in the accompanying drawings.

First Embodiment

Figure 1:
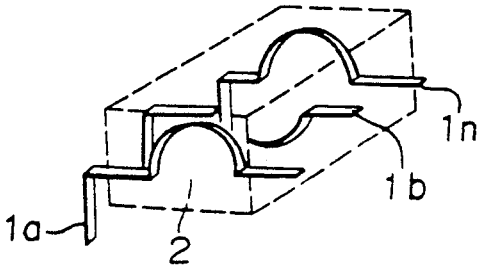
FIG. 1 is a perspective view showing the structure of a first embodiment of the connector according to the present invention.

FIG. 1 is a perspective view showing the structure of the first embodiment of the connector according to the present invention.

1. Structure

In FIG. 1, reference numerals 1*a*, 1*b*, . . . 1*n* designate one or more shaped conductors lying in substantially parallel planes as illustrated, for connection which are processed to include a half-round longitudinal cross-sectional form (to form a coil having a half turn). The half-round portion formations are preferably provided or arranged in alternately vertically opposite directions (wherein the convex shape and the concave shape are alternately repeated) to avoid mutual interference between adjacent conductors. The shaped conductors are transversely embedded in a magnetic body 2 along the length of the body which is prepared by densely sintering or shaping, e.g., a plastic ferrite material (in a molded form or compound form referred to hereinafter as a magnetic compound).

One example of the chemical composition of the magnetic compound of the present invention is as follows:

| | |
|---|---|
| Ferrite | 87.0 wt. % |
| Epoxy resin | 8.2 wt. % |
| Curing agent for epoxy resin | 4.3 wt. % |
| Catalyst for epoxy resin | 0.1 wt. % |
| Releasing agent | 0.2 wt. % |
| Coupling agent | 0.2 wt. % |
| | 100.0 wt. % |

Figure 1A:
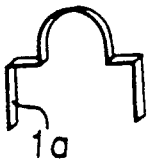
FIGS. 1*a* and 1*b* are perspective views showing two examples of shaped conductors for connection which can be utilized in the first embodiment.
Figure 1B:
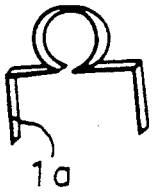

The shaped conductor 1*a* for connection can be shaped so as to have a substantially round form (one turn) as shown in FIG. 1*b* instead of having the half-round shape (half turn) as shown in FIG. 1*a*. The number of turns can be plural. The shape of the turn can be linear or rectangular. These shaped portions can project to one side direction instead of alternately extending in vertically opposite directions.

Figure 2A:
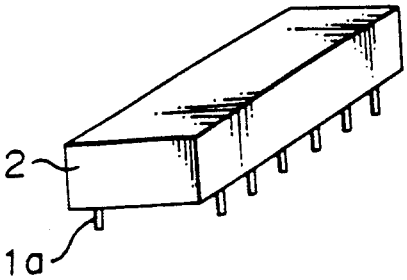
FIGS. 2*a*, 2*b* and 2*c* are perspective views showing three examples of the appearance of the first embodiment.
Figure 2B:
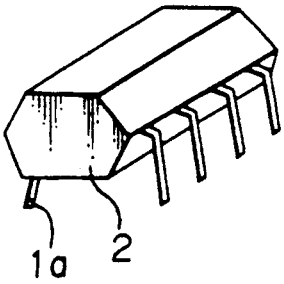

FIGS. 2*a* and 2*b* are perspective views showing the appearance of two examples of DIP (i.e., dual-in-line-package) of an ordinary IC (i.e., integrated circuit) in accordance with the first embodiment of FIG. 1.

Figure 2C:
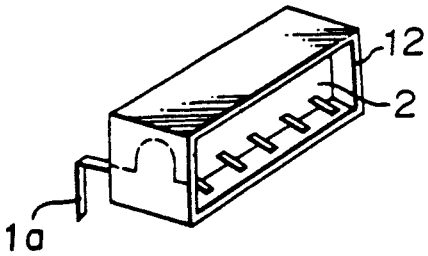

FIG. 2*c* is a perspective view showing the appearance wherein the magnetic compound body with the conductors embedded in it is covered with a metallic case as needed. The presence of the metallic case can offer an electrostatic shielding effect.

2. Operation

Figure 3:
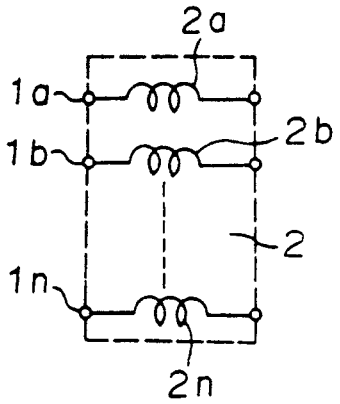
FIG. 3 is an equivalent circuit diagram of the first embodiment.

FIG. 3 is an electrical equivalent circuit diagram of the first embodiment.

Electric signals are given to each end of each conductors 1*a*, 1*b*, . . . 1*n*, and are output from the other end of each of the conductors. The dc components in the signals can be transmitted through the conductors without being substantially attenuated. High frequency components in the signals can be prevented by equivalent inductances 2*a*, 2*b*, . . . 2*n* which comprise the conductors 1*a*, 1*b* . . . 1*n* and the magnetic body 2, respectively, thereby allowing for a good noise filter effect to be realized.

Second Embodiment

1. Structure

Figure 4:
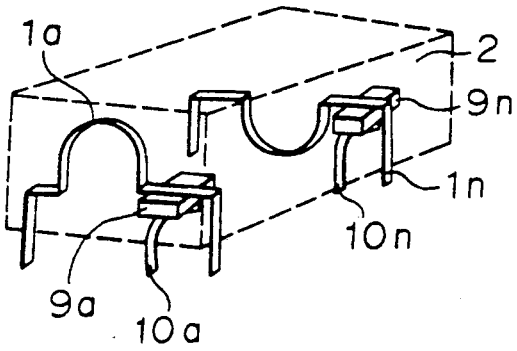
FIG. 4 is a perspective view showing the structure of a second embodiment of the present invention.

FIG. 4 is a perspective view showing the structure of the second embodiment. The second embodiment is characterized in that one or more shaped conductors 1*a*, 1*b*, . . . 1*n* for connection have their one ends connected to chip capacitors 9*a*, 9*b*, . . . ,9*n*, in that the capacitors have their other ends connected to terminals 10*a*, 10*b*, . . . 10*n* for connection, and in that the conductors, the chip capacitors and the terminals are embedded in a sintered or shaped magnetic body 2.

Figure 4A:
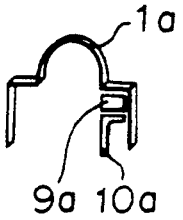
FIGS. 4*a* and 4*b* show two examples of the shape of conductors for connection which can be utilized in the second embodiment.
Figure 4B:
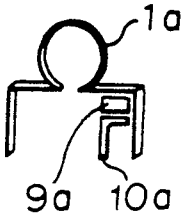

FIGS. 4*a* and 4*b* are perspective views showing the appearance of two examples of the shaped conductor in accordance with the second embodiment.

Figure 5A:
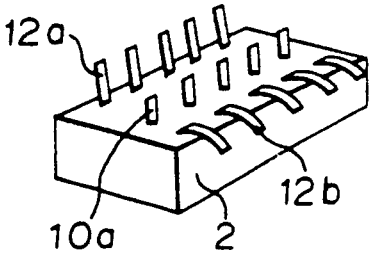
FIGS. 5*a* and 5*b* are perspective views showing two examples of the appearance of the second embodiment.
Figure 5B:
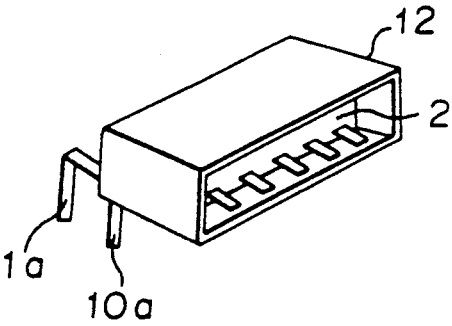

FIGS. 5*a* and 5*b* are perspective views showing the appearance of two examples in accordance with the second embodiment. In FIG. 5*b*, the magnetic compound body 2 can be covered with a metallic case 12 a needed to add electrostatic shielding effect to the noise filter effect.

2. Operation

Figure 6:
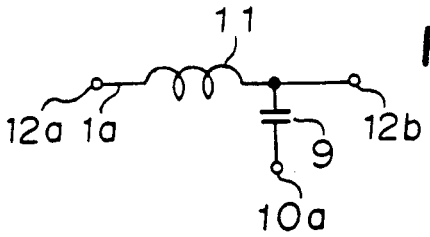
FIG. 6 is an equivalent circuit diagram of the second embodiment.

FIG. 6 is an electrical equivalent circuit diagram of the second embodiment.

Since the conductors 1*a*, . . . 1*n* are sealed in the magnetic compound body 2, they can function as inductors as shown in an equivalent inductance 11 in FIG. 6. The conductors also form LC filters together with the chip capacitors 9*a*, 9*b* . . . 9*n*, each of which is connected to one end of the equivalent inductance.

In the equivalent circuit of FIG. 6, a signal which has been input from a terminal 12*a* has its noise component absorbed by the equivalent inductance 11 and the capacitor (capacitance) 9, and is output from the other terminal 12*b*. In this manner, a high frequency noise component can be eliminated. The other end 10*a* of the equivalent capacitance is grounded in terms of an ac component. Since the conductors 1*a*, . . . 1*n* are sealed in the magnetic compound body 2, the connector according to the present invention can absorb both conduction noise and radiation noise.

Third Embodiment

Figure 7:
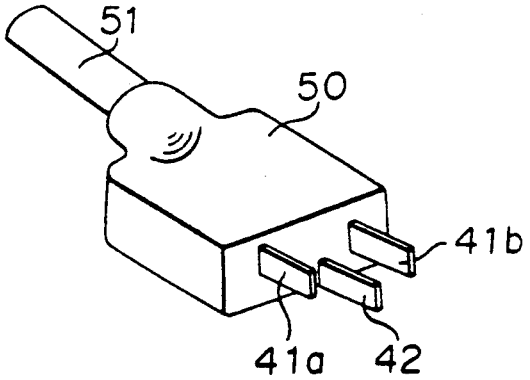
FIG. 7 is a perspective view showing the appearance of an AC plug as a third embodiment.
Figure 8:
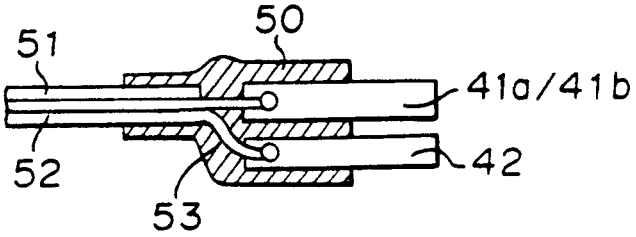
FIG. 8 is a vertical cross sectional view of the third embodiment.
Figure 19:
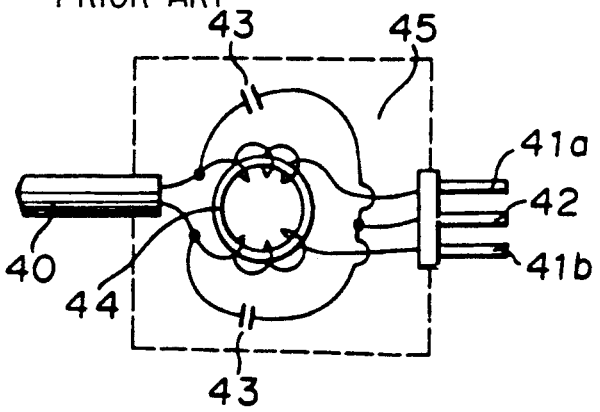
FIGURE 19 PRIOR ART
FIG. 19 is a connection diagram showing an application example of a conventional AC plug.

FIG. 7 is a perspective view showing the appearance of an AC plug with a noise filter as the third embodiment, the AC plug being one of the application examples of the connector wherein the principle of the present invention is utilized. FIG. 8 is a vertical cross sectional view showing the AC plug, the same reference numerals indicating constituent elements similar or corresponding to those of the conventional device of FIG. 19.

1. Structure

Reference numerals 41*a* and 41*b* indicate a pair of AC plug pins. Reference numeral 42 designates a ground terminal pin. Reference numeral 50 designates a shaped plug body which is molded from the magnetic compound. Reference numeral 51 designates a grounded cable, which includes wires 52, and a grounded wire in its interior. These constituent elements have their end portions molded in or sealed by the magnetic compound 50 as shown in FIG. 8.

2. Operation

Noise components which have flowed in from the plug pins 41*a* and 41*b* can be attenuated by a choke coil component since the pins 41*a* and 42*b*, and the wires 52 in the cable 51 are embedded in the magnetic compound 50 to have an inductance component, thereby functioning as a choke coil. As a result, the present invention can provide a small sized and lightweight AC plug.

3. Other Embodiments

Figure 9:
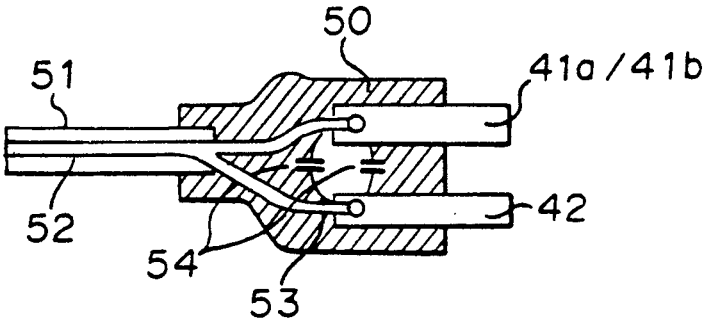
FIGS. 9 and 10 are vertical cross sectional views showing two other examples of the plug as shown in FIG. 7.
Figure 10:
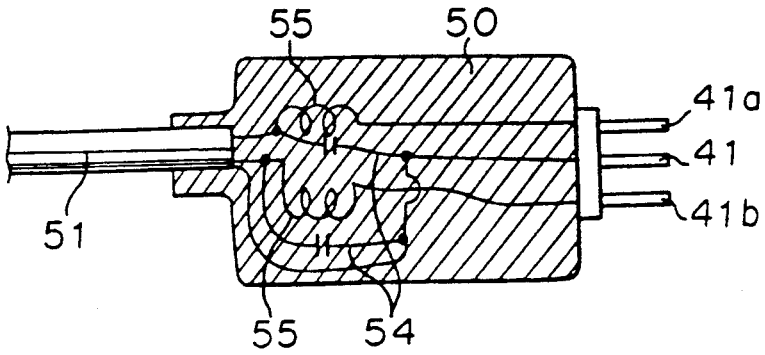

Explanation of the embodiments as stated earlier have been made for the case wherein the cable 51 is molded and sealed by the magnetic compound 50. As shown in the vertical cross sectional views of FIGS. 9 and 10, a pair of capacitors 54 can be arranged, or a pair of coils 55 can be added to the paired capacitors 54, and the paired coils 55 are embedded in the magnetic compound 50, thereby allowing the noise eliminating effect to be remarkably improved.

Figure 11:
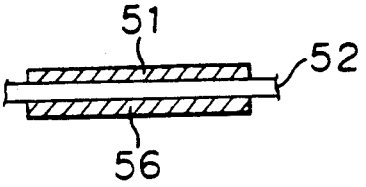
FIG. 11 is a cross sectional view showing a part of the cable of the plug shown in FIG. 7.
Figure 12:
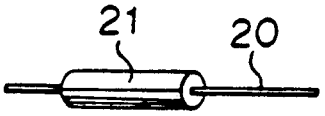
FIGURE 12 PRIOR ART
FIG. 12 is a perspective view showing an example of a conventional type of connector.
Figure 13:
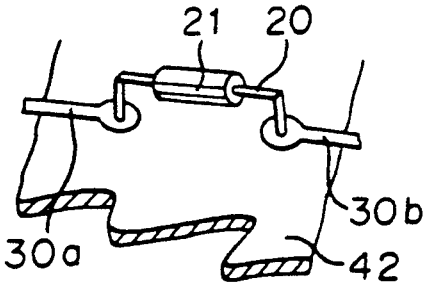
FIGURE 13 PRIOR ART
FIG. 13 is a perspective view showing how the conventional connector of FIG. 12 is mounted.
Figure 14:
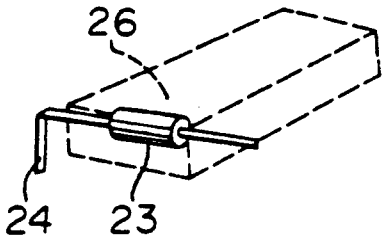
FIGURE 14 PRIOR ART
FIGS. 14 through 16 are perspective views showing three examples, respectively, of conventional noise eliminating filters.
Figure 15:
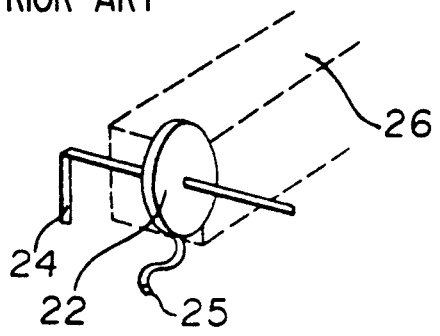
FIGURE 15 PRIOR ART
Figure 16:
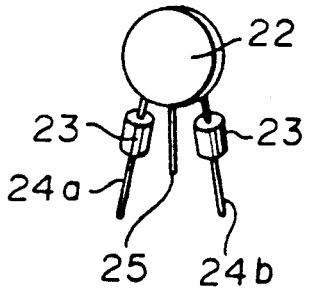
FIGURE 16 PRIOR ART
Figure 17:
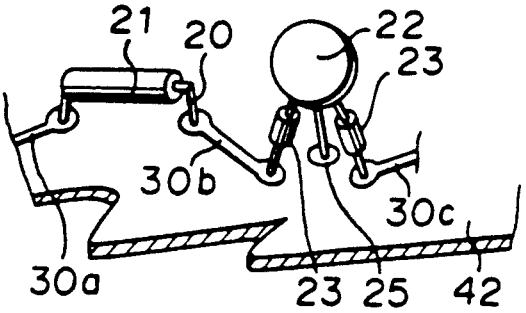
FIGURE 17 PRIOR ART
FIG. 17 is a perspective view showing how the filter of FIG. 16 is mounted.
Figure 18:
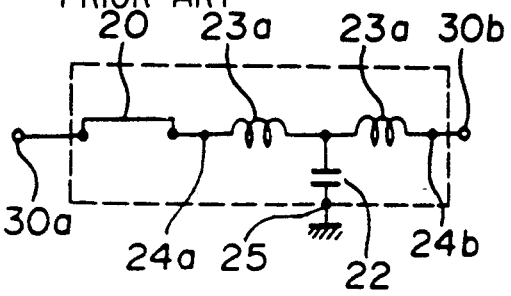
FIGURE 18 PRIOR ART
FIG. 18 is an equivalent circuit diagram of the electrical circuit of FIG. 16.

As shown in a fragmentary sectional view showing a cable in FIG. 11, insulating coating 56 of the cable 51 can be made from e.g. a ferrite compound like the plug main body 50, thereby providing noise absorbing effect to the entirety of the cable.

Figure 20:
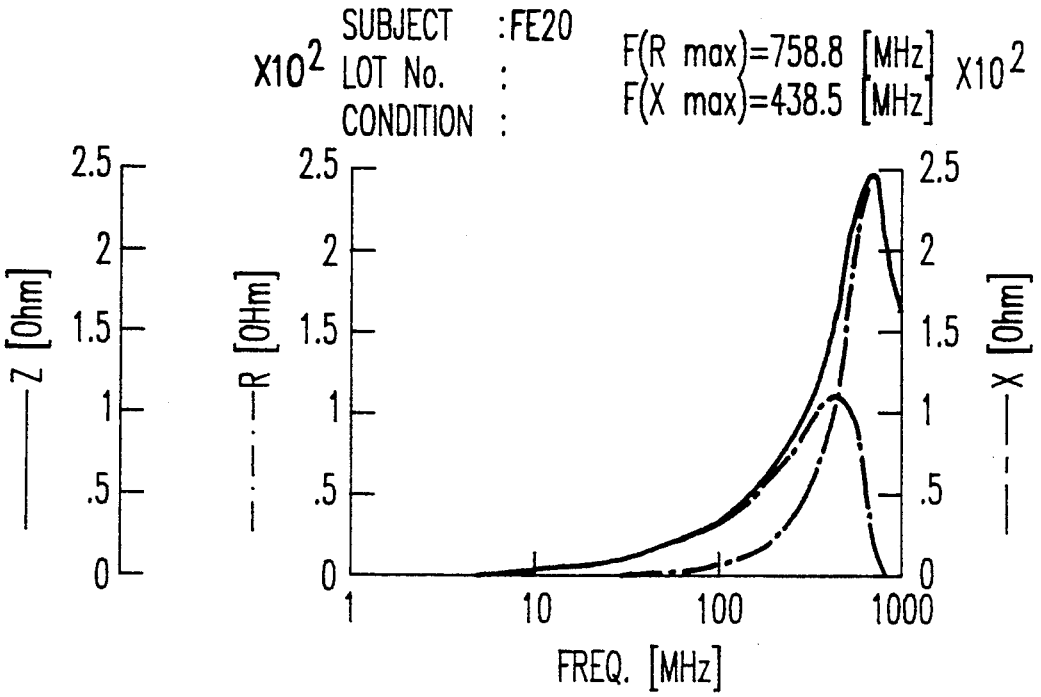
FIG. 20 shows noise absorbing characteristics of a device wherein a conductor is sealed by the magnetic compound of the present invention.
Figure 21:
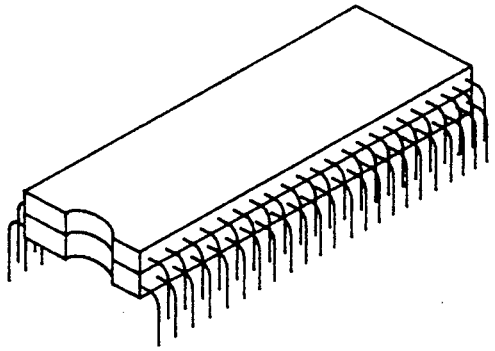
FIG. 21 shows the device having the characteristics shown in FIG. 20.

With regard to noise characteristics of the magnetic body, a magnetic body made of a conventional ferrite core suppresses noises whose frequencies are up to about 100 MHz. On the other hand, the magnetic compound body in accordance with the present invention can suppress noises whose frequencies are up to approximately 1,000 MHz. FIG. 20 shows the noise absorbing characteristics of the device, wherein a conductor is sealed only by the magnetic compound in accordance with the present invention. FIG. 21 illustrates the appearance of the device having the characteristics of FIG. 20. Although the magnetic compound body of the present invention is slightly lower than the ferrite beads previously referred to in this application, it is conceivable that the frequency characteristics of the magnetic compound body in accordance with the present invention has infinite applications.

Although an explanation of the embodiments as stated earlier has been provided above in the case of a fixed connector and the application example of the AC plus has been discussed, the present invention is also applicable to a disconnector or other switching devices so as to obtain an effect similar to the embodiments explained above.

Obviously, numerous modifications and variations of the present invention are possible in light of the above teachings. It is therefore to be understood that within the scope of the appended claims, the invention may be practiced otherwise than a specifically described herein.

What is claimed as new and desired to be secured by Letters Patent of the United States is:

1. A connector for connecting an electrical circuit, which comprises:

a plurality of conductors lying in parallel planes and embedded in a magnetic body of a magnetic compound, transverse to the length of said magnetic body, so as to function as inductance wherein said magnetic compound comprises a compound for suppressing noises whose frequencies are greater than 100 MHz and less than 1,000 MHz, and wherein at least a portion of said conductors have at least partially rounded longitudinal cross-sectional forms.

2. A connector according to claim 1, which comprises a capacitor connected at one end of at least one of said plurality of conductors and wherein said capacitor is connected to a terminal.

3. A connector according to claim 1, wherein at least a portion of said conductors have a substantially half-round shaped longitudinal cross-section form.

4. A connector according to claim 1, wherein said conductors alternately extend in opposite directions.

5. A connector according to claim 1, wherein said conductors extend in the same direction.

6. A connector for connecting an electrical circuit, which comprises a plurality of conductors lying in parallel planes and embedded in a magnetic body of a magnetic compound, transverse to the length of said magnetic body, so as to function as inductance wherein said magnetic compound comprises a compound for suppressing noises whose frequencies are greater than 100 MHz and less than 1,000 MHz and wherein said conductors have a substantially rectangularly shaped longitudinal cross-sectional form.

7. A connector which comprises:

a main body portion having a magnetic compound;

a pair of plug pins embedded in said magnetic compound; and a cable having wires connected to end portions of said plug pins and embedded in said magnetic compound.

8. A connector according to claim 7, which comprises a pair of capacitors embedded in said magnetic compound and connected to said end portion of said plug pins.

9. A connector according to claim 8, which comprises a coil embedded in said magnetic compound and connected to each said capacitor and each of said plug pins.

* * * * *